United States Patent [19]

Anhalt

[11] Patent Number: 4,533,198

[45] Date of Patent: Aug. 6, 1985

[54] INSULATION DISPLACEMENT CONNECTOR

[75] Inventor: John W. Anhalt, Orange, Calif.

[73] Assignee: International Telephone & Telegraph Corp., New York, N.Y.

[21] Appl. No.: 523,235

[22] Filed: Aug. 15, 1983

[51] Int. Cl.[3] ..... H01R 13/39

[52] U.S. Cl. ..... 339/99 R

[58] Field of Search ..... 339/97 R, 97 P, 98, 339/99 R

[56] References Cited

U.S. PATENT DOCUMENTS 3,142,524 7/1964 McDonough ..... 339/98

*Primary Examiner*—Joseph H. McGlynn

*Attorney, Agent, or Firm*—T. L. Peterson

[57] ABSTRACT

An insulation displacement connector is disclosed which is particularly adapted for use with flat cable having closely spaced conductors. The termination end of each contact in the connector is formed by slitting the contact body and then offsetting the arms formed by the slit in opposite directions. Each conductor of the flat cable is pushed between the offset arms of a corresponding contact. A cap is mounted over the rear of the connector. Cavities in the cap having inclined walls engage the free ends of the resilient arms of the contacts urging them inwardly toward each other to ensure that a high strength connection will be maintained between the contacts and the conductors.

14 Claims, 12 Drawing Figures

INSULATION DISPLACEMENT CONNECTOR

BACKGROUND OF THE INVENTION

The present invention relates generally to an electrical connector and, more particularly, to an insulation displacement connector for flat cables.

Mass termination techniques utilizing insulation displacement connectors have been common place throughout the industry. Such techniques allow rapid interconnections to be made between the conductors of a flat cable and the contacts of the connector by simply clamping the cable between the connector cap and housing thereby forcing the cable conductors into slots in the contacts. Generally the termination ends of the contacts are in the form of slotted plates. U.S. Pat. No. 4,118,096 and Dutch Pat. No. 67298 disclose a variety of slotted plate type of insulation displacement contacts. The slotting of the contact produces what might be considered to be a double tine termination system in which each tine of the slotted contact is located on opposite sides of the cable conductor. It will be appreciated that because of the double tine system there is a limitation on the closeness of the spacing of the contacts and, therefore, miniaturization of cable/connector assembly. U.S. Pat. No. 4,118,096 teaches forming lateral projections on the tines that engage the sides of openings in the connector cap to increase the pressure applied on the conductor by the tines.

U.S. Pat. Nos. 4,190,942 and 3,816,818 disclose insulation displacement connectors in which each contact is in-line or on-edge with respect to the conductors of the flat cable as opposed to being perpendicular to the conductors as in the conventional slotted plate type of contact. In the in-line type of insulation displacement contact a slot in the contact is not produced by the blanking or removing of material as in the conventional slotted plate contact, but rather is produced by slitting a generally flat plate and then offsetting the tines or arms which are produced by the slit. Connection of the conductor to the contact is achieved by inserting the conductor into the slot formed by the offset tines. This type of contact allows a closer center-to-center spacing of the contacts in the connector housing so that the length of the connector may be reduced.

In each of the contacts discussed above the resilient tines or arms formed by the slots or slits, respectively, form a pair of cantilever beams which spread outwardly when the conductor of a flat cable is pushed downwardly into the slot provided between the tines. In the case of the conventional slotted plate contact, the width of the cantilever beams at the root of the beams is relatively great as compared to the thickness of the metal sheet from which the contact is formed so that the cantilever beams have substantially high strength. In contrast, with the in-line type of contact in which a flat plate is simply slit and the thus formed tines are offset from each other, the thickness of the cantilever beams at the root of the beams is only that of the thickness of the gauge of the sheet metal used to make the contact. As a consequence, the strength of the beams is substantially reduced. As a result, the electrical connection made between the contact and the conductor pushed between the tines is not as strong or reliable as when using the slotted plate type of contact. It is the object of the present invention to provide means for making the in-line type of insulation displacement contact stronger and more reliable.

SUMMARY OF THE INVENTION

According to a principal aspect of the present invention, there is provided an insulation displacement connector containing a row of contacts. Each contact has a termination end which is bifurcated providing a pair of resilient tines or arms which are bent in opposite directions away from a plane extending transversely of the row of contacts thus providing an in-line type of contact arrangement as discussed previously herein. The arms of each contact have forward stationary portions and rear free end portions which are movable relative to said transverse plane, and intermediate conductor engaging portions. A cap is mounted over the rear of the insulator having a row of recesses therein spaced to receive therein the free end portions of the arms of the respective contacts. Each recess embodies means which restrict the free end portions of the contact therein from moving outwardly away from said plane whereby when a conductor extending transversely of the row of contacts is pushed between the arms to the intermediate portions thereof and the cap is mounted on the rear of the insulator, the intermediate portions of the arms will become bowed around the conductor so that the arms will produce a resilient engaging force against the opposite sides of the conductor. By this arrangement, the resilient force between the contact and the conductor will be sufficiently strong and may be maintained for a long period of time to ensure a high strength, reliable electrical connection between the contact and the conductor even when the connector is subjected to high vibration and temperature cycling. Thus, the present invention provides a highly reliable electrical connection in an insulation displacement connector having in-line type of contacts which permit close center-to-center spacing of the contacts and thus allows the connector to be made relatively short thereby permitting miniaturization of the connector.

DESCRIPTION OF THE PREFERRED EMBODIMENT

Figure 1:
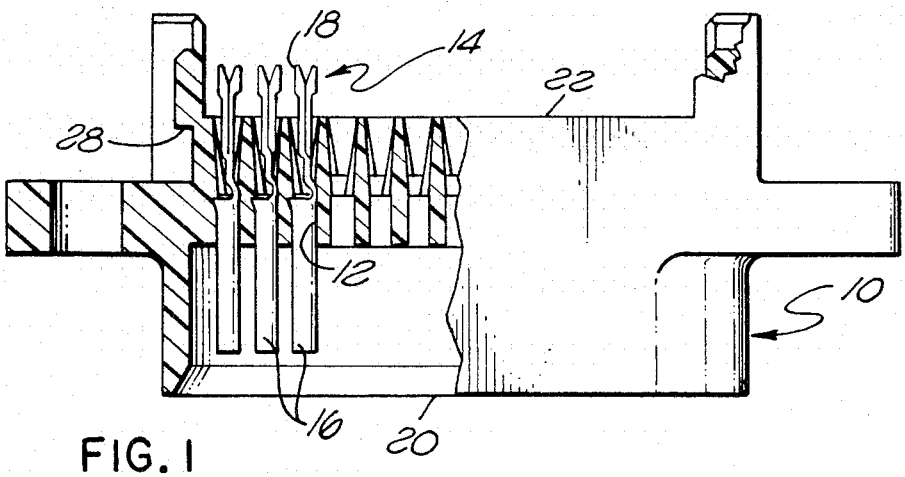
FIG. 1 is a partial sectional view taken lengthwise through the housing of the connector of the present invention showing several contacts mounted in the housing.
Figure 2:
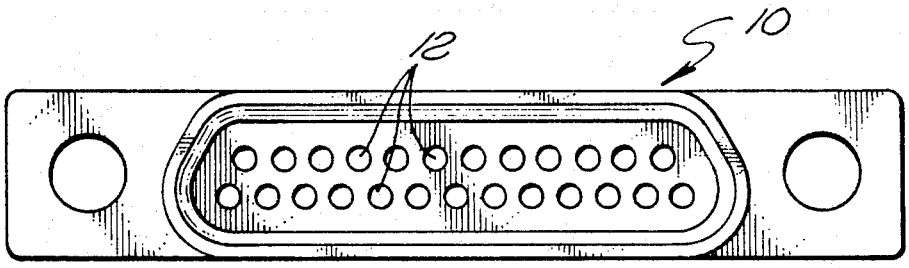
FIG. 2 is a front end view of the housing illustrated in FIG. 1.
Figure 3:
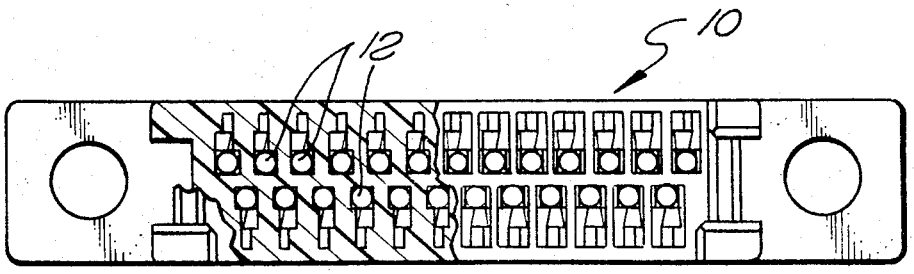
FIG. 3 is a rear end view of the housing illustrated in FIG. 1.

Referring now to the drawings in detail, FIGS. 1 to 3 illustrate the insulative housing 10 of the connector of the present invention which contains two rows of contact cavities 12. As seen in FIGS. 2 and 3, the cavities in the two rows are staggered relative to each other. Insulation displacement contacts 14 of the in-line type are mounted in the cavities 12. Each contact embodies a forward mating portion 16, which is shown as being in the form of a socket although it could be a pin, and a rear termination portion 18. The sockets extend forwardly toward the front 20 of the housing 10 while the termination portions of the contacts 18 extend rearwardly from a rearwardly facing surface 22 of the connector housing.

Figure 4A:
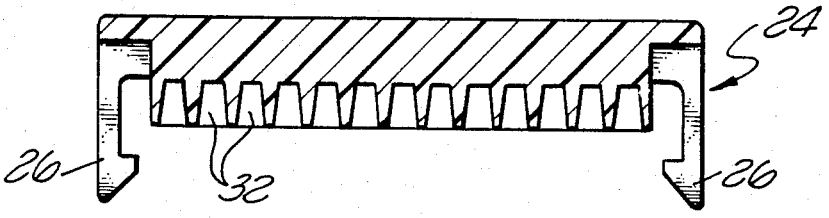
FIG. 4*a* is a partial sectional view taken lengthwise of the cap which is mounted on the rear of the housing illustrated in FIGS. 1 to 3.
Figure 4B:
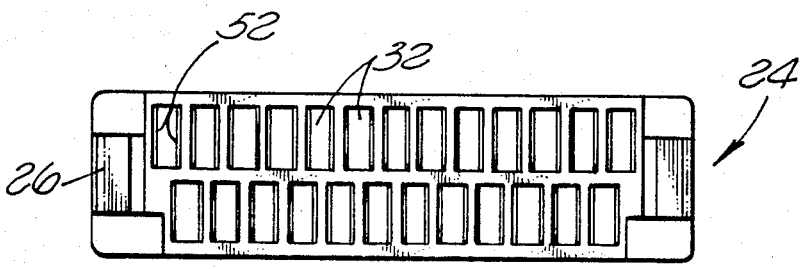
FIG. 4*b* is a front end view of the cap illustrated in FIG. 4*a*.
Figure 5:
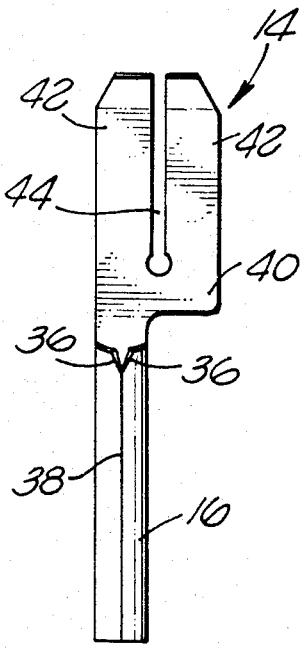
FIG. 5 is a plan view of one of the contacts utilized in the connector of the invention.
Figure 9:
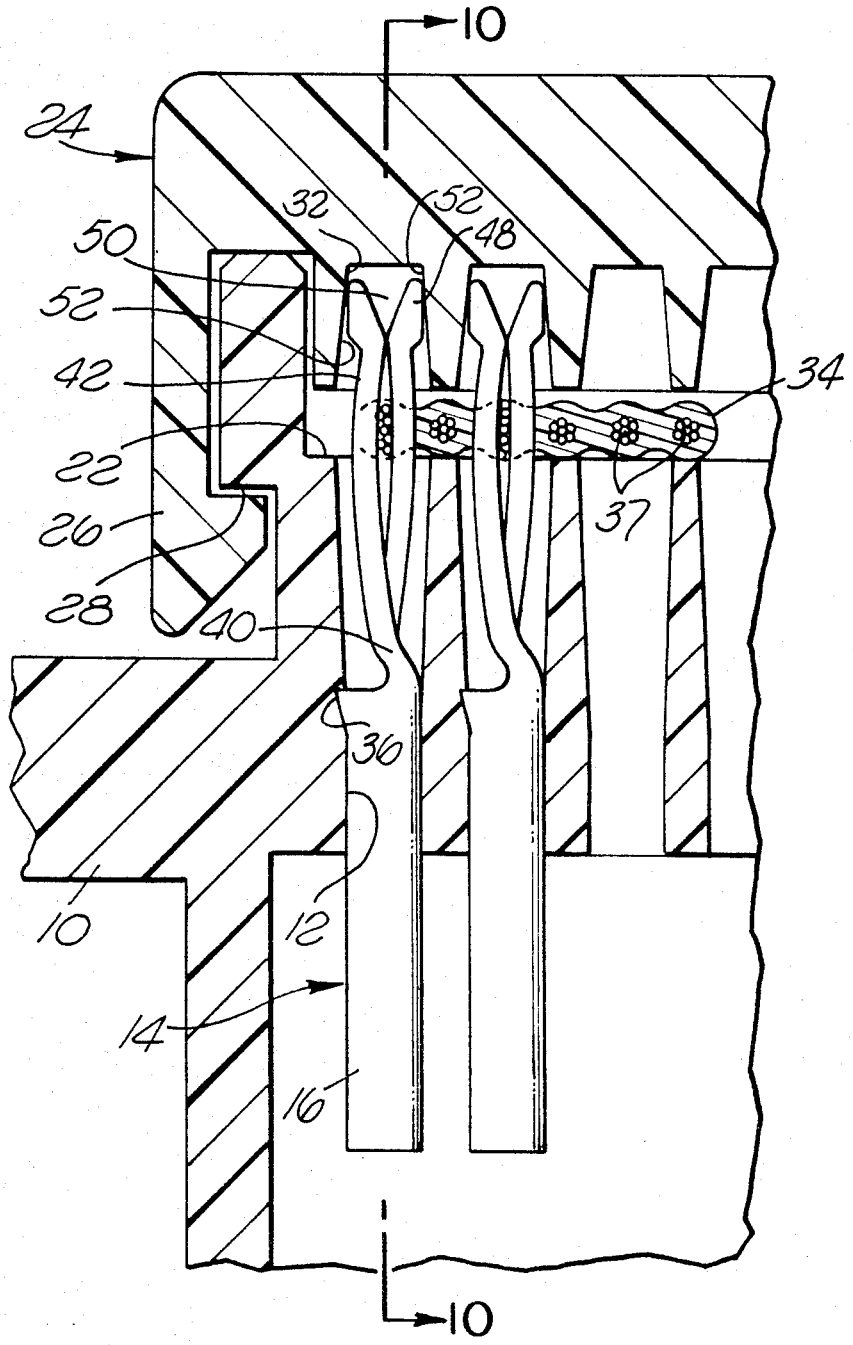
FIG. 9 is a fragmentary, sectional view through a portion of the connector of the present invention with the cap shown mounted on the housing and showing two contacts terminated to the conductors of a flat cable trapped between the cap and the housing.
Figure 10:
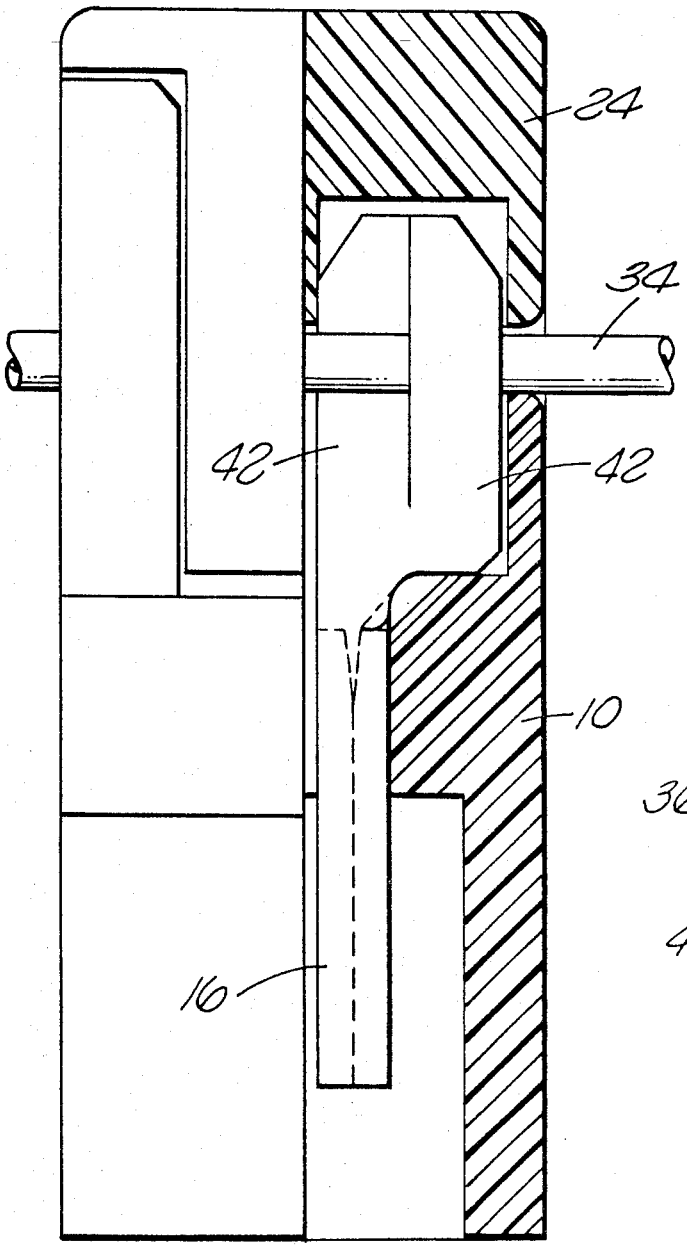
FIG. 10 is a sectional view taken along line 10-10 of FIG. 9 showing one contact terminated to a conductor of the flat cable.

FIGS. 4*a* and 4*b* illustrate a cap 24 which is mounted on the rear of the housing 10 as can be seen in FIGS. 9 and 10. The cap embodies a pair of resilient latches 26 on its opposite ends which engage behind shoulders 28 (only one said shoulder being visible in FIG. 1) for securing the cap on the housing. The cap embodies two staggered rows of forwardly opening recesses 32 which receive the rear termination portions 18 of the contacts when the cap is mounted on the rear of the housing. The cap serves to push a flat cable 34 over the exposed rear ends of the contacts as seen in FIGS. 9 and 10. The cable contains a plurality of parallel, spaced conductors 37 which are shown as being stranded wire conductors although they could be single wire conductors. Furthermore, discrete insulated conductors could be utilized with the connector of the invention rather than a flat cable.

Figure 6:
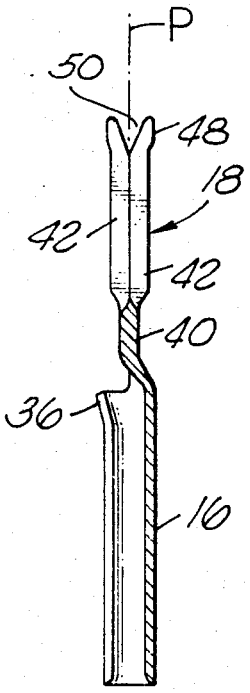
FIG. 6 is a partial longitudinal sectional view of the contact illustrated in FIG. 5, rotated 90°.
Figure 8:
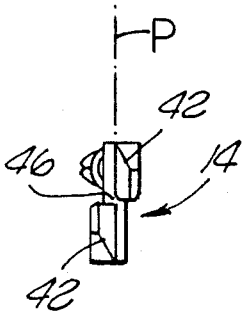
FIG. 8 is a rear view of the contact illustrated in FIG. 6.
Figure 7:
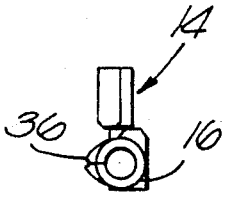
FIG. 7 is a front end view of the contact illustrated in FIG. 6.

Reference is now made to FIGS. 5 to 8 which show in detail the structure of the contact 14 of the present invention. The contact is formed from sheet metal. The forward socket 16 of the contact is rolled into tubular form and is dimensioned to receive therein a mating pin contact, not shown. The rear edges 36 of the forward tubular section 16 adjacent to the seam 38 thereof are flared outwardly so that such edges will bite into the wall of the contact cavity to retain the contact therein as seen in FIG. 9. The rear termination portion 18 of the contact includes a generally flat base 40 and a pair of rearwardly extending generally flat resilient tines or arms 42. The arms are formed by cutting a slit 44 lengthwise in the sheet metal from which the contact is made. As best seen in FIGS. 6 and 8, the spring arms 42 are bent outwardly adjacent to the flat base 40 away from a plane P which passes through the base. Thus the arms are parallel to and offset from each other, providing a conductor receiving slot 46 therebetween as seen in FIG. 8. It can be seen (e.g. FIG. 6) that the slot has a substantially zero width as viewed along the direction of the axis of a conductor immediately prior to reception of the conductor into the slot; that is, the initial width (if any) of the slot is less than half the width of the conductor to be received in the slot. The outer tips 48 of the arms are further bent outwardly to provide an entryway 50 therebetween for guiding a conductor into the slot 46. As seen in FIGS. 1, 9 and 10, the contacts are mounted in the cavities 12 in the connector housing so that the flat bases 40 thereof extend transverse to the row of contacts. As a consequence, the conductor engaging arms 42 of the rear termination portions of the contacts are in-line or parallel to the conductors 36 of the flat cable which is mounted over the rear of the housing transverse to its longitudinal extent. Because of the in-line configuration of the contacts, the contacts may be mounted with a close center-to-center spacing within the connector housing so as to accommodate flat cables having very closely positioned conductors therein.

Because the forward sections of the resilient arms 42 of each contact are integrally joined with the base 40 thereof, such sections are stationary. The stationary portions of the arms are located within the contact cavity 12. The rear free end portions 48 of the arms are spaced behind the rear surface 22 of the housing. The intermediate portions 50 of the arms immediately behind the surface 22 are the conductor engaging portions of the arms. Each resilient arm 42 forms a cantilever beam. The root of each beam adjacent to the base 40 of the contact has a thickness of the gauge of the sheet metal from which the contact is formed, which is relatively thin, thus resulting in cantilever beams having relatively low strength. By comparing FIGS. 5 and 6 it can be seen that the thickness of the base 40 and of each substantially flat arm 42 is less than half the width of each arm in a direction parallel to the axes of the conductors immediately prior to their reception in the contacts. According to the invention, the outward free ends 48 of the cantilever beams or arms 42 are supported in such a fashion that the intermediate portions of the arms are caused to bow around the conductors 37 of the flat cable 34 when the latter is pushed over the rear termination ends of the contacts so that the arms will produce a strong resilient engaging force against the opposite sides of the conductor. To this end the opposite sides 52 of each recess 32 in the cap 24 of the connector, in the lengthwise direction of the cap, are tapered so as to diverge inwardly and rearwardly as seen in FIGS. 4*a* and 9. The tapered sides 52 of the recesses 32 in the cap and the free ends 48 of the arms of the contacts are dimensioned such that when the cap is mounted over the rear of the connector housing without any conductors mounted therebetween, the free ends of the arms will engage but will not necessarily be resiliently urged against the sides of the recess. However, when the flat cable 34 is pushed over the rear termination portions of the contacts by the cap to force the conductors 37 thereof into the slots 46 in the rear of the contacts the intermediate portions 50 of the arms 42 will be spread apart yet will obtain a bowed configuration as seen in FIG. 9 due to the support provided against the free ends 48 of the arms of the contacts by the tapered sides 52 of the recesses 32. The width of the slot is uniform between forward and rearward locations before a conductor is received. It can be seen that the degree of bowing is great enough that the separation of the arms at the conductor is more than twice the separation (if any) at the forward location of the previously uniform slot, as viewed along the axis of the conductor prior to its reception in the contact. Thus, the sides 52 tend to urge the free ends of the contacts inwardly toward each other, or toward the plane P, assuring a continuous stressing of the resilient arms 42 around the conductors so that the arms will produce a strong resilient engaging force against opposite sides of the conductors even though the roots of the arms are very thin. It is noted that during the time that the cap is pushed over the rear termination portions of the contacts to push the conductors of the flat cable into the contacts, because the free ends of the arms are continuously spaced from the bottoms of the recesses 32, the arms will be free to shift longitudinally slightly within the recesses to permit the bowing of the intermediate conductor engaging portions of the contact arms.

Since the conductors 37 of the flat cable 34 are shown as being multiple strand wire conductors, the conductors will flatten somewhat due to the displacement of the individual wires when the conductors are pushed into the slots between the arms 42 of the contacts. The continuous force produced upon the free ends of the arms by the engagement of the tapered sides 52 on the cap causing the arms to bow will provide a long term, reliable electrical connection with the conductors of the cable even though there may be some yielding or movement of the individual wires of the multiple strand conductors over time.

Figure 11:
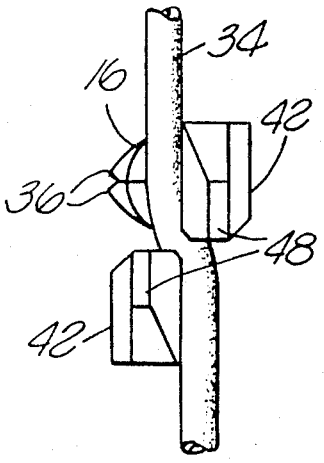
FIG. 11 is a rear view of a contact shown terminated to a conductor.

It will be appreciated that the flat cable could utilize single wire conductors, or individual discrete wires could be used each covered by insulation. Reference is made to FIG. 11 which shows a rear end view of the contact of the present invention with a single wire conductor mounted in the slot 46 formed between the spring arms 42 of the contact.

What is claimed is:

1. An electrical connector for a plurality of generally parallel conductors comprising:

an insulator having a front and a rear;

a plurality of contacts mounted in a row in said insulator, each said contact having a termination end extending outwardly from a rearwardly facing surface of said insulator;

the termination end of each said contact being bifurcated providing a pair of resilient arms, said arms of each contact being bent in opposite directions away from a plane extending transversely of said row providing therebetween a slot for reception of a respective conductor when the plurality of conductors is positioned transverse of said row and the conductors are pushed downwardly over the rear of said insulator;

said arms of each said contact having forward stationary portions and rear free end portions movable relative to said transverse plane therebetween, and intermediate conductor engaging portions;

a cap adapted to be mounted on the rear of said insulator;

said cap having a row of recesses therein spaced to receive therein said free end portions of said arms of the respective contacts when said cap is mounted on the rear of said insulator; and each said recess embodying means for restricting the free end portions of the arms of the contact therein from moving outwardly away from said plane whereby when a conductor extending transversely of said row is pushed between said arms to said intermediate portions and said cap is mounted on said rear of said insulator, said intermediate portions of said arms will become bowed around said conductor so that said arms will produce a resilient engaging force against the opposite sides of the conductor;

the slot in each contact has substantially zero width as viewed along the axis of the conductor immediately prior to reception of the conductor into the slot, and said means for restricting the free end portions of the arms holds said free end portions sufficiently close so they remain at substantially their original spacing and the middle portions of said arms are bowed around said conductor.

2. An electrical connector as set forth in claim 1 wherein:

said arms are generally flat and parallel to said plane.

3. An electrical connector as set forth in claim 1 wherein:

said free ends of said arms are free to shift longitudinally within said recesses.

4. An electrical connector as set forth in claim 1 wherein:

the arms of each said contact embody elongated side edges shaped to displace insulation covering said conductor and electrically engage the conductor when pushed into said slot.

5. An electrical connector as set forth in claim 4 wherein:

said side edges are the edges of said arms closest to each other.

6. An electrical connector as set forth in claim 5 wherein:

said termination end of each said contact is bifurcated by a narrow slit, and said side edges of said contacts lie essentially on a second plane extending lengthwise of said row.

7. An electrical connector as set forth in claim 1 wherein:

said restricting means for each said contact comprises opposite walls of said recess lying on opposite sides of said plane.

8. An electrical connector as set forth in claim 7 wherein:

said walls are inclined inwardly toward each other in the rearward direction.

9. A contact connected to an electrical conductor comprising:

a contact body having a forward mating end and a rear termination end;

said termination end being bifurcated providing a pair of resilient arms, said arms being bent in opposite directions away from a plane extending lengthwise of said contact body and providing a slot therebetween that is of largely uniform width between forward and rearward locations when no conductor lies therein;

said arms having forward stationary portions and rear free end portions movable relative to said transverse plane;

a conductor extending generally along a predetermined conductor axis lying in said plane, said conductor pushed into said slot and lying substantially within said plane at a position between the free end portions and stationary portions of said arms;

means urging the free end portions of the arms toward said plane; and said arms being bowed around said conductor sufficiently that the width of said slot as viewed along said conductor axis is at least twice as wide at said pushed-in conductor as at said forward location along said slot, whereby said arms produce a resilient engaging force against the opposite sides of said conductor.

10. The contact and conductor combination as set forth in claim 9 wherein:

said arms are generally flat and parallel to said plane.

11. The contact and conductor combination as set forth in claim 9 wherein:

said contact is an insulation displacement contact;

said conductor is covered with insulation; and the arms of said contact embody elongated side edges displacing said insulation and electrically engaging said conductor.

12. The contact and conductor combination as set forth in claim 11 wherein:

said side edges are the edges of said arms closest to each other.

13. An electrical connector for receiving a flat cable containing a plurality of conductors each of predetermined width, said conductors extending along parallel axes and surrounded by insulation, comprising:

a row of contacts constructed to receive said conductors of said cable, each contact having a pair of arms that lie primarily on opposite sides of a corresponding conductor axis, said arms each having a free rearward end, and the separation of said arms being substantially uniform between forward and rearward locations along the arms when the conductor does not lie between the arms;

a housing which includes means for holding said conductors;

a cap which fits over said housing, said cap having means engaging the free ends of said arms to limit their separation;

said arms of each contact being sufficiently long and resilient and said means on said cap holding the free ends of said contact arms sufficiently close to each other as viewed along the axis of the corresponding conductor, that when the conductor is pushed between the arms and the cap is on the housing, the arms are bowed so their separation at the conductor is at least twice their separation at said rearward location along said slot, as viewed along the conductor axis.

14. The connector as set forth in claim 13 wherein:

said contacts each have an elongated slit between said arms; and each contact is formed of sheet metal and has a flat base portion, and said arms each extend from said flat base portion but are bent in opposite directions so one lies substantially to one side of the base portion and the other lies substantially to the opposite side of the base portion, even when no conductor lies between the arms.

* * * * *